United States Patent [19]

Camilleri

[11] 4,171,809

[45] Oct. 23, 1979

[54] RESPOT CELL PROTECTIVE BEARING MEMBER

[76] Inventor: Thomas M. Camilleri, 277 Ave. West, Brooklyn, N.Y. 11223

[21] Appl. No.: 823,094

[22] Filed: Aug. 9, 1977

[51] Int. Cl.[2] ..... A63D 5/08

[52] U.S. Cl. ..... 273/42 A; 16/DIG. 27; 308/238

[58] Field of Search ..... 273/42 A, 43 A; 16/DIG. 27; 308/3 C, 6 R, 238; 312/341 NR

[56] References Cited

U.S. PATENT DOCUMENTS

| | | | |
|---|---|---|---|
| 2,606,091 | 8/1952 | Buchy et al. | 312/341 NR |
| 2,757,051 | 7/1956 | Wilmer et al. | 312/341 R X |
| 3,194,615 | 7/1965 | Weasler | 308/238 X |
| 3,315,961 | 4/1967 | Congelli et al. | 273/43 A |
| 3,572,863 | 3/1971 | Josephson | 308/238 |

*Primary Examiner*—Anton O. Oechsle

*Attorney, Agent, or Firm*—Donald J. Perrella

[57] ABSTRACT

The end of the gripping finger member of a respot cell is provided with a tightly fitted elastomeric wheel-like protective bearing member.

2 Claims, 2 Drawing Figures

RESPOT CELL PROTECTIVE BEARING MEMBER

BACKGROUND OF THE INVENTION

1. Field of the Invention

The present invention relates to a respot cell for an automatic pinsetting bowling machine. More particularly it relates to a protective member adapted to fit over the end of the gripping members of the respot cell.

The heretofore known protective member for the gripping members consist of a U-shaped member formed of rigid plastic which is screwed to the end of the gripping member. A major disadvantage of these protective members is that they crack and break in use necessitating removal and replacement.

2. Objects of the Invention

It is, accordingly, an object of the present invention to provide a protective member which resists cracking and breaking in use. Another object is to provide a protective member which is self adhering without requiring the use of a screw, and which is also readily installed and removed. These and other objects of the present invention will be apparent from the following description.

SUMMARY OF THE INVENTION

A protective bearing member for the end of a gripping finger member for a respot cell is formed of a tightly fitted self-adhering, readily installed and removed wheel-like member formed of an elastomeric material.

DETAILED DESCRIPTION

Figure 1:
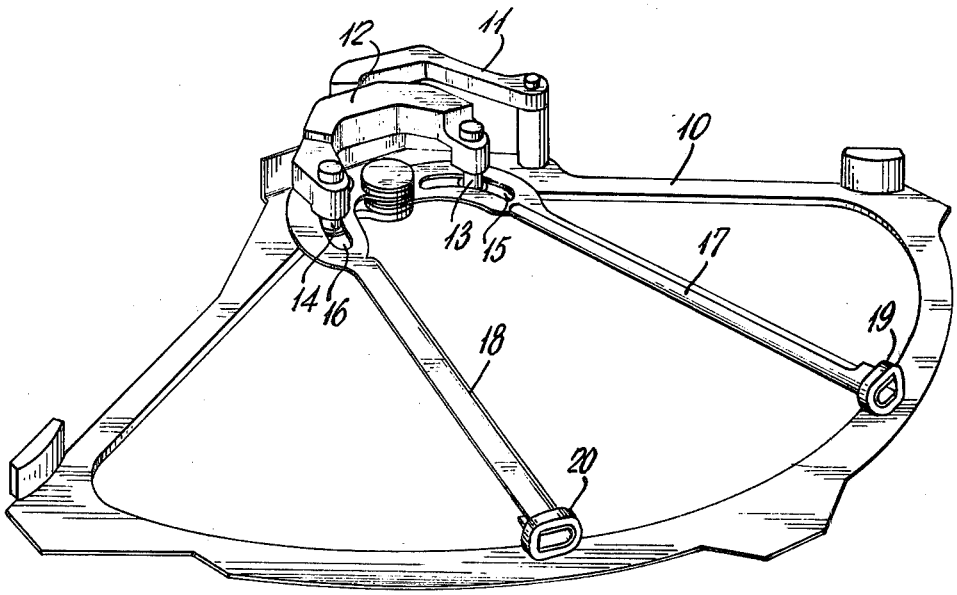
FIG. 1 is a perspective view of the gripping elements of a respot cell.

As shown in FIG. 1 the gripping element of a respot cell contains a metal chassis 10 formed of two straight sides and a curved front. A lever arm 11 activates a U-shaped yoke 12 provided with posts 13 and 14. Post 13 moves in slot 15 of finger 17, while post 14 moves in slot 16 of finger 18. The end of finger 17 is provided with a wheel-like elastomeric member 19. The end of finger 18 is provided with a similar wheel-like elastomeric member 20. Members 19 and 20 serve to raise the ends of members 17 and 18, and when fingers 17 and 18 are moved towards each other or away from each other in response to forward or rearward movement of lever arm 11, members 19 and 20 slide along the curved front of chassis 10. Stops at the front portion of each of the straight sides of chassis 10 limit the outward movement of fingers 17 and 18.

Member 19 is substantially wheel-like in structure and is formed of elastomeric material, e.g. rubber, polyurethane, neoprene. It has a diameter of about 0.69 inch (1.75 cm) and a central opening of about 0.19 inch (0.48 cm). The surface of member 19 which contacts and slides on the curved front of chassis 10 may be concave as shown, or convex or straight. The diameter of the central opening is equal to about $\frac{1}{3}$ of the diameter of member 19.

Figure 2:
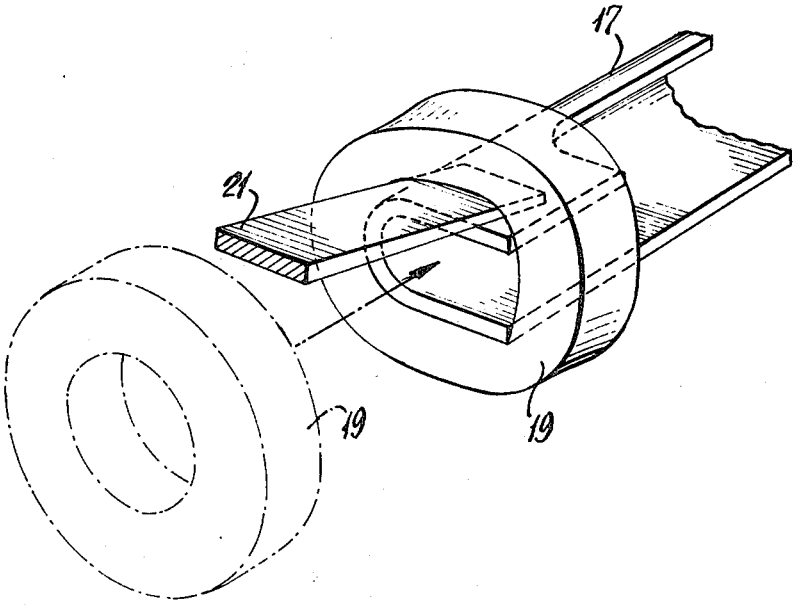
FIG. 2 is a perspective view showing the method of applying the protective member to the end of a gripping member.

The manner of attaching members 19 and 20 is shown in FIG. 2 with specific reference to member 19. As the opening of member 19 is too small to permit member 19 to slip over the end of member 17, one side of member 19 is slipped over the bottom of member 17 while a blade member 21 is slipped through the opening and brought to rest on the end of member 19. Then by raising blade 21, the opening is widened and member 19 can be fitted over the top of member 17 as blade 21 is slipped back through the opening.

What is claimed is:

1. In a respot cell for an automatic bowling machine comprising a chassis and two finger members having a C-shaped cross section for gripping a bowling pin, the improvement wherein the end of at least one finger member is provided with a substantially wheel-like elastomeric member having an opening too small to permit the elastomeric member from being slipped over the end of the finger member without enlarging the opening, the elastomeric member adapted to be enlarged by stretching over the end of the C-shaped finger member and to be self adhering thereto, the wheel-like member completely encircling the finger member.

2. A respot cell according to claim 1 wherein the end of each finger member is provided with a substantially wheel-like elastomeric member having an opening too small to permit the elastomeric member from being slipped over the end of the finger member without enlarging the opening, the elastomeric member adapted to be stretched to fit over the end of the C-shaped finger member and to be self adhering thereto, the wheel-like member completely encircling the finger member.

* * * * *